US007431616B2

(12) United States Patent
Minich

(10) Patent No.: US 7,431,616 B2
(45) Date of Patent: Oct. 7, 2008

(54) ORTHOGONAL ELECTRICAL CONNECTORS

(75) Inventor: Steven E. Minich, York, PA (US)

(73) Assignee: FCI Americas Technology, Inc., Carson City, NV (US)

( * ) Notice: Subject to any disclaimer, the term of this patent is extended or adjusted under 35 U.S.C. 154(b) by 293 days.

(21) Appl. No.: 11/367,745

(22) Filed: Mar. 3, 2006

(65) Prior Publication Data

US 2007/0205774 A1 Sep. 6, 2007

(51) Int. Cl.
*H01R 13/648* (2006.01)

(52) U.S. Cl. ..... 439/608

(58) Field of Classification Search ..... 439/608, 439/701

See application file for complete search history.

(56) References Cited

U.S. PATENT DOCUMENTS

| | | | | |
|---|---|---|---|---|
| 2,664,552 | A | 12/1953 | Ericsson et al. | 339/192 |
| 3,115,379 | A | 12/1963 | McKee | 439/290 |
| 3,827,005 | A | 7/1974 | Friend | 339/258 |
| 4,030,792 | A | 6/1977 | Fuerst | 339/17 |
| 4,482,937 | A * | 11/1984 | Berg | 361/789 |
| 4,898,539 | A | 2/1990 | Glover et al. | 439/81 |
| 4,900,271 | A | 2/1990 | Colleran et al. | 439/595 |
| 5,004,426 | A | 4/1991 | Barnett | 439/82 |
| 5,046,960 | A | 9/1991 | Fedder | |
| 5,575,688 | A | 11/1996 | Crane, Jr. | 439/660 |
| 5,634,821 | A | 6/1997 | Crane, Jr. | 439/660 |
| 5,637,019 | A | 6/1997 | Crane, Jr. et al. | 439/677 |
| 5,980,321 | A | 11/1999 | Cohen et al. | 439/608 |
| 6,116,926 | A | 9/2000 | Ortega et al. | 439/108 |
| 6,179,663 | B1 | 1/2001 | Bradley et al. | 439/608 |
| 6,227,882 | B1 | 5/2001 | Ortega et al. | 439/101 |
| 6,293,827 | B1 | 9/2001 | Stokoe | 439/608 |
| 6,299,483 | B1 | 10/2001 | Cohen et al. | 439/608 |
| 6,302,711 | B1 | 10/2001 | Ito | 439/83 |
| 6,328,602 | B1 | 12/2001 | Yamasaki et al. | 439/608 |
| 6,375,478 | B1 * | 4/2002 | Kikuchi | 439/79 |
| 6,379,188 | B1 | 4/2002 | Cohen et al. | 439/608 |
| 6,414,248 | B1 | 7/2002 | Sundstrom | |
| 6,464,529 | B1 | 10/2002 | Jensen et al. | |
| 6,503,103 | B1 * | 1/2003 | Cohen et al. | 439/608 |
| 6,506,076 | B2 | 1/2003 | Cohen et al. | 439/608 |
| 6,540,522 | B2 | 4/2003 | Sipe | 439/61 |
| 6,551,140 | B2 * | 4/2003 | Billman et al. | 439/608 |
| 6,572,409 | B2 | 6/2003 | Nitta et al. | 439/608 |
| 6,592,381 | B2 * | 7/2003 | Cohen et al. | 439/80 |
| 6,672,907 | B2 | 1/2004 | Azuma | 439/682 |
| 6,692,272 | B2 | 2/2004 | Lemke et al. | 439/108 |

(Continued)

*Primary Examiner*—Neil Abrams
(74) *Attorney, Agent, or Firm*—Woodcock Washburn LLP

(57) ABSTRACT

A connector may include lead frame assemblies that each includes contacts arranged in a column. Differential signal pairs may be formed from contacts of adjacent lead frame assemblies. A contact of such differential signal pairs may be staggered along the lead frame assembly with respect to the other contact of the pair. Additionally, adjacent lead frame assemblies may be structurally identical but one of the lead frame assemblies may be rotated 180° with respect to the adjacent lead frame assembly. A connector may include contacts that may be front loaded so that, after the connector is connected to a substrate, individual contacts may be removed without removing the connector from the substrate. The connectors may be capable of being rotated 90° relative to one another such that they may be connected to opposite sides of a substrate such as a midplane.

23 Claims, 13 Drawing Sheets

U.S. PATENT DOCUMENTS 6,695,627 B2 2/2004 Ortega et al. ..... 439/78
6,736,664 B2 5/2004 Ueda et al. ..... 439/423
6,746,278 B2 6/2004 Nelson et al. ..... 439/608
6,749,439 B1 6/2004 Potter et al. ..... 439/65
6,764,341 B2 7/2004 Lappoehn ..... 439/608
6,808,420 B2 10/2004 Whiteman, Jr. et al. ..... 439/608
6,843,686 B2 1/2005 Ohnishi et al. ..... 439/608
6,848,944 B2 2/2005 Evans
6,851,980 B2 2/2005 Nelson et al. ..... 439/608
6,893,686 B2 5/2005 Egan ..... 427/496
6,913,490 B2 7/2005 Whiteman, Jr. et al. ..... 439/608
6,918,789 B2 7/2005 Lang et al. ..... 439/608
6,945,796 B2 9/2005 Bassler et al.
6,979,215 B2 12/2005 Avery et al.
6,981,883 B2 1/2006 Raistrick et al. ..... 439/74
6,994,569 B2 2/2006 Minich et al.
7,021,975 B2 4/2006 Lappohn ..... 439/733.1
7,094,102 B2 8/2006 Cohen et al. ..... 439/608
7,108,556 B2 * 9/2006 Cohen et al. ..... 439/608
2003/0116857 A1 6/2003 Tanigughi et al.
2004/0224559 A1 11/2004 Nelson et al.
2004/0235321 A1 11/2004 Mizumura et al. ..... 439/92
2005/0032401 A1 2/2005 Kpbayashi ..... 439/76.2
2005/0170700 A1 8/2005 Shuey et al. ..... 439/701
2005/0196987 A1 9/2005 Shuey et al. ..... 439/108
2005/0215121 A1 9/2005 Tokunaga ..... 439/608
2005/0227552 A1 10/2005 Yamashita et al. ..... 439/862
2006/0024983 A1 2/2006 Cohen et al. ..... 439/61
2006/0068641 A1 3/2006 Hull et al. ..... 439/608
2006/0073709 A1 4/2006 Reid ..... 439/65
2006/0228912 A1 10/2006 Morlion et al. ..... 439/65
2006/0232301 A1 10/2006 Morlion et al. ..... 326/126

* cited by examiner

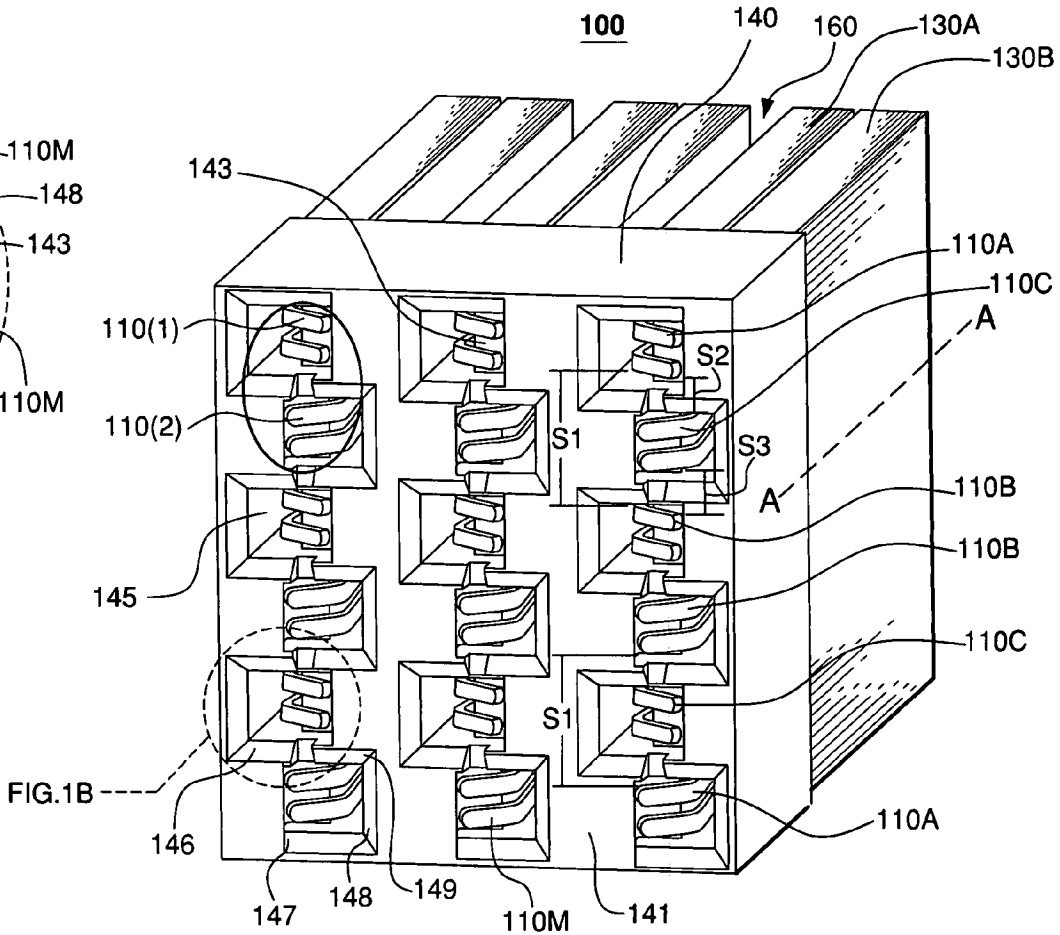
FIG.1A
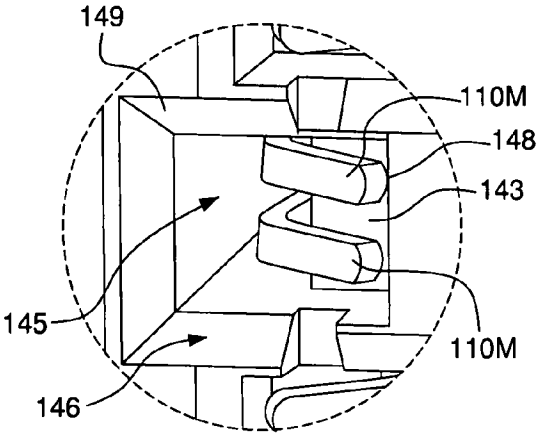
FIG.1B
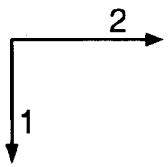

ORTHOGONAL ELECTRICAL CONNECTORS

CROSS REFERENCE TO RELATED APPLICATIONS

The present application is related by subject matter to U.S. patent application Ser. No. 11/367,784, filed on Mar. 3, 2006 and titled "Edge and Broadside Coupled Connector," U.S. patent application Ser. No. 11/368,211, filed on Mar. 3, 2006 and titled "High-Density Orthogonal Connector," and U.S. patent application Ser. No. 11/367,744, filed on Mar. 3, 2006 and titled "Broadside-to-Edge-Coupling Connector System," the contents of each of which are hereby incorporated by reference in their entireties.

FIELD OF THE INVENTION

The invention generally relates to electrical connectors and in particular to electrical connectors with improved characteristics.

BACKGROUND

An electrical connector may include one or more lead frame assemblies. Each lead frame assembly may include a dielectric lead frame housing, and a plurality of electrical contacts extending through the housing. The contacts in each lead frame assembly may form a linear array. Lead frame assemblies of alternative embodiments may include any number of contacts.

The contacts may be signal contacts or ground contacts. Signal contacts may be used for single-ended signal transmission. Two adjacent signal contacts may form a differential signal pair. Contacts may be arranged in linear arrays along an axis of the lead frame housing. Contacts may be arranged in any arrangement of signal contacts and ground contacts. For example, contacts may be arranged in signal-ground-signal-ground arrangement, signal-signal-ground arrangement, or signal-signal-ground-ground arrangement.

SUMMARY

The present invention generally relates to electrical connectors that operate above a 1.5 Gigabit/sec data rate, and preferably above 10 Gigabit/sec, such as at 250 to 30 picosecond rise times. Crosstalk between differential signal pairs may be generally six percent or less. Impedance may about 100±10 Ohms. Alternatively, impedance may be about 85±10 Ohms. There are preferably no shields between differential signal pairs. Air or plastic can be used as a dielectric material. Column pitch is about 1.5 mm or more, such as 2.0, 1.9, 1.8, 1.7, 1.6, 1.5, 2.1, 2.2, 2.5, 2.7, 2.8, 2.9, and 3.0 or more. Skew is minimized in the vertical connector configuration because the contact lengths are substantially equal. A connector according to the present invention may include lead frame assemblies that each includes contacts arranged in a column. The contacts may carry ground or single-ended or differential signal transmissions. Differential signal pairs may be formed from contacts of adjacent lead frame assemblies. A contact of such differential signal pairs may be staggered along the lead frame assembly with respect to the other contact of the pair. Additionally, adjacent lead frame assemblies may be structurally identical but one of the lead frame assemblies may be rotated 180° with respect to the adjacent lead frame assembly. The contacts of the lead frame assemblies may be spaced apart from each other such that the spacing between contacts of each differential signal pair is equal to such spacing of the other differential signal pairs. Additionally, the spacing between differential signal pairs may be equal within the lead frame assembly, and the spacing between differential signal pairs may be equal to the spacing between contacts of a differential signal pair.

The connector may be connected to a second connector that includes contacts that may be stitched into a connector body and may be front loaded so that, after the second connector is connected to a substrate, whether by press-fit or solder, individual contacts may be removed from the second connector without removing the second connector from the substrate.

The connectors may be capable of being rotated 90° relative to one another and connected to opposite sides of a substrate such as a midplane. In this way, two orthogonal daughtercards may be connected to a substrate.

BRIEF DESCRIPTION OF THE DRAWINGS

FIG. 1A is a perspective front view of an example embodiment of an electrical connector.

FIG. 1B is a partial view of the example connector in the area of the mating end of a contact.

DETAILED DESCRIPTION OF ILLUSTRATIVE EMBODIMENTS

Figure 2:
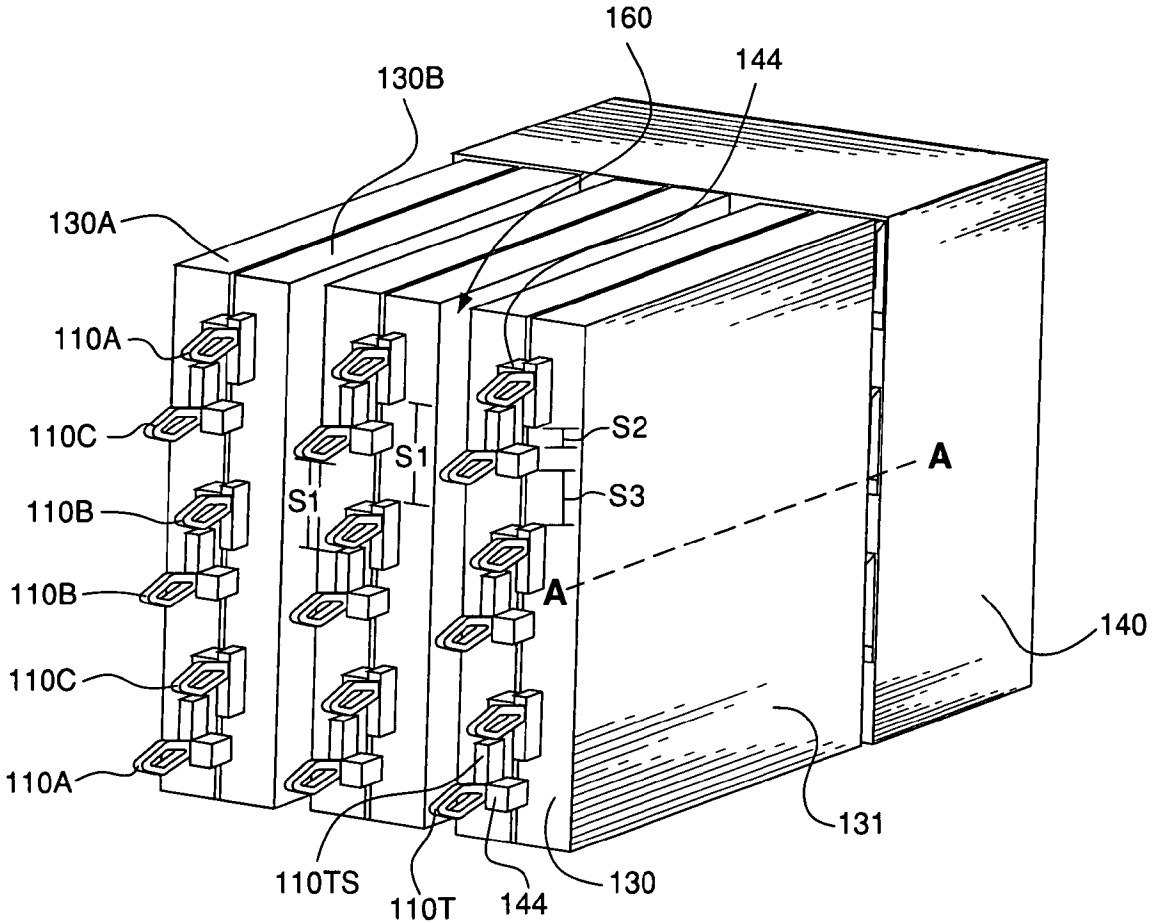
FIG. 2 is a perspective back view of the example connector.

FIG. 1A is a perspective front view of an example embodiment of an electrical connector 100. The electrical connector 100 may operate above a 1.5 Gigabit/sec data rate, and preferably above 10 Gigabit/sec, such as at 250 to 30 picosecond rise times. Crosstalk between differential signal pairs of the connector 100 may be generally six percent or less. Impedance may about 100±10 Ohms. Alternatively, impedance may be about 85±10 Ohms. There are preferably no shields between differential signal pairs.

Air or plastic can be used as a dielectric material. Column pitch is about 1.5 mm or more, such as 2.0, 1.9, 1.8, 1.7, 1.6, 1.5, 2.1, 2.2, 2.5, 2.7, 2.8, 2.9, and 3.0 or more. The electrical connector 100 may include one or more lead frame assemblies 130A, 130B and a housing 140. A connector may include any number of lead frame assemblies 130A, 130B, and the example connector 100 includes, for purposes of example, six lead frame assemblies 130A, 130B. The lead frame assemblies 130A, 130B may be evenly spaced within a connector consistent with alternative embodiments. In the example connector 100, the lead frame assemblies are grouped into pairs such that two lead frame assemblies 130A, 130B abut each other. Paired lead frame assemblies 130A, 130B may be spaced apart by a space 160 from other paired lead frame assemblies. In this way, the connector 100 may be devoid of any ground planes or shields extending between the lead frame assemblies 130A, 130B or may be devoid of any ground planes, shields, or ground contacts within the connector 100.

Each lead frame assembly 130A, 130B may include contacts 110 extending in the housing 140. The contacts 110 in each lead frame assembly 130A, 130B may form a linear array or a contact column extending in a direction indicated by arrow 1. Lead frame assemblies of alternative embodiments may include any number of contacts. In the example connector 100, each linear array includes three contacts 110A, 110B, 110C. The contacts 110 may be used for single-ended signal transmission. In such a case, for example, the contacts 110C and 110B in a lead frame assembly 130B may be signal conductors and the contacts 110A and 110B in lead frame assembly 130A may be a ground contacts. The contacts 110, alternatively, may be used for differential signal transmission. For example, the contact 110A in the lead frame assembly 130A and the contact 110C in the lead frame assembly 130B may form the first of three differential signal pairs along the arrow 1 direction. Alternatively, contacts 110B in leadframe assemblies 130A, 130B may be grounds. Other contact arrangements are envisioned.

In the example connector 100, contact 110A in leadframe 130A may be paired with contact 110C of an adjacent lead frame assembly 130B rather than with contact 110B within the same lead frame assembly 130A. Thus, as shown by the circled contacts 110(1), 110(2) in FIG. 1A, the contact 110(1) of one lead frame assembly 130 may form a differential signal pair with the contact 110(2) of an adjacent lead frame assembly 130. In such an embodiment, the lead frame assembly 130 may be devoid of ground contacts. In the embodiments, contacts forming differential signal pairs each may be the same distance in the direction indicated by the arrow 1 from a top edge of the connector housing 140. That is, contacts forming a differential signal pair may be even with each other or not offset relative to one another in the direction in which the lead frame assembly 130 extends (i.e., in the direction indicated by the arrow 1). As shown in FIG. 1A, the contact 110(2) alternatively may be spaced from contact 110(1) in the direction indicated by arrow 1 and offset in the direction indicated by the arrow 2 relative to the contact 110(1). Such offsetting may enable a smaller "pitch"—or distance—between the contacts 110(1) and 110(2) in a direction indicated by the arrow 2, that is, in a direction perpendicular to the direction in which the lead frame assemblies 130 extend. In one embodiment of the invention, such a pitch may be about 1.3 mm or less if plastic is used as a dielectric material. The pitch may be smaller in air.

The contacts 110 may extend from the lead frame assemblies 130 into the housing 140 toward a mating side 141 of the connector 100. The contacts 110 may be exposed by apertures 145 in the housing 140. The apertures 145 may be defined in the housing 140 by surfaces or walls 146, 147, 148, 149. While the apertures 145 are shown as rectangles, they may be any shape. Additionally, the apertures 145 may be sized based on the size of the contacts 110 as well as the size of contacts that may be inserted into the apertures 145 to mate with the contacts 110. The walls 146, 147, 148, 149 may be tapered to provide a "lead-in" surface, helping to guide contacts of an electrical connector mating with the electrical connector 100 into the apertures 145 to mate with the contacts 110. The placement of the apertures 145 may be based on the location of the contacts 110 within the lead frame assemblies 130.

As shown in FIG. 1A and as shown in greater detail in FIG. 1B, the contacts 110 may include a mating end 110M that may be bent, for example, in a direction parallel to the direction indicated by the arrow 2. The mating ends 110M of the contacts 110 may be bent to provide a lead-in surface, aiding in guiding a mating contact of another connector as the other connector is connected to the connector 100. Alternatively, the contacts may be straight with no bending or may be bent in any appropriate orientation. To minimize wipe distance, the bend is preferably as close to the mating end of the contact as possible.

Within each aperture 145 may be a block 143. The block 143 may protrude from a side wall 146, 148 of the aperture 145. The wall 146, 147, 148, 149 from which the block protrudes may depend on the design characteristics of the connector 100, such as the direction in which the mating ends 110M of the contacts 110 may be bent. As a contact 110 is inserted into the aperture 145, the contact 110 may flex slightly as the portion of the contact behind the mating end 110M rides against the block 143. When fully inserted, the mating ends 100M of the contacts may touch or may be spaced slightly away from the wall 146 of the aperture 145. The contacts 110 may be retained at a rear end, and are cantilevered from the retention point to provide normal force against a mating contact. As shown in FIGS. 1A and 1B, the mating ends 100M may deflect away from the wall 146 when a mating contact (not shown) is inserted into the aperture 145.

The lead frame assemblies 130A, 130B may be paired such that, for example, a first lead frame assembly 130A abuts a second lead frame assembly 130B. The lead frame assemblies 130A, 130B may be structurally identical for a vertical configuration and different for a right angle configuration. For example, each lead frame assembly 130 may include contacts 110 in identical orientations (e.g., mating end 110M bending in the same direction) with identical spacing between the contacts 110 of the lead frame assembly (such as the lead frame assembly 130A). For example, the lead frame assembly 130A may include contacts 110A, 110B, 110C forming a linear array with a spacing S1 between each of the contacts 110 in the linear array. The lead frame assembly 130B may also include contacts 110A, 110B, 110C with a spacing S1 between each of the contacts 110 in the linear array. The lead frame assembly 130B, however, may be rotated 180° around an axis A with respect to the lead frame assembly 130A with which it is paired.

In the connector 100, therefore, the contact 110A of the lead frame assembly 130A may be paired with the contact 110C of the lead frame assembly 130B. The contacts 110B of each lead frame assembly 130A, 130B may be paired together. Finally, the contact 110C of the lead frame assembly 130A may be paired with the contact 110A of the lead frame assembly 130B. Such a configuration additionally may result in the spacing S2 between contacts 110 of a differential signal pair to be the same as the spacing S3 between adjacent differential signal pairs. S3 may also be larger than S2.

The mating ends 110M of the contacts 110 may be retained wholly within the housing 140 or may extend so that each is flush with the mating side 141 of the housing 140. In this way, the connector 100 may be connected to a substrate through use of flat rock application tooling. That is, a flat rock tool may be pressed against the mating side 141 of the connector 100 and towards a substrate to which the connector 100 may be connected. The pressure may be applied generally within a middle portion of the mating side 141 or along the mating side to connect the connector 100. Thus, no special tooling may be required to connect the connector 100.

FIG. 2 is a perspective back view of the example connector 100. The lead frame assemblies 130 may be paired with the space 160 between the pairs of lead frame assemblies 130A, 130B. The contacts 110 may be insert molded as part of a lead frame body 131 of the lead frame assemblies 130 and may include terminal ends 110T extending from the lead frame bodies 131. The terminal ends 110T may be for electrically connecting to a substrate such as a printed circuit board. The terminal ends 110T may be for press-fit engagement with the substrate. Alternatively, the terminal ends 110T may be soldered to the substrate or connected by any other appropriate method, such as a pressure mount.

As described herein, the lead frame assemblies 130 of the connector 100 may be structurally the same. Each lead frame assembly 130 may include contacts 110 having terminal ends 110T in identical orientation, including identical spacing between the contacts 110 of the lead frame assemblies 130. For example, the lead frame assembly 130A may include contacts 110A, 110B, 110C forming a linear array with a spacing S1 between each of the contacts 110 in the linear array. The lead frame assembly 130B may also include contacts 110A, 110B, 110C with a spacing S1 between each of the contacts 110 in the linear array. The lead frame assembly 130B, however, may be rotated 180° around an axis A with respect to the lead frame assembly 130A with which it is paired.

The contact 110A of the lead frame assembly 130A may be paired with the contact 110C of the lead frame assembly 130B. The contacts 110B of each lead frame assembly 130A, 130B may be paired together. Finally, the contact 110C of the lead frame assembly 130A may be paired with the contact 110A of the lead frame assembly 130B. Such a configuration additionally may result in the spacing S2 between contacts 110 of a differential signal pair to be the same as the spacing S3 between adjacent differential signal pairs. Alternatively, the spacing between contacts in a differential signal pair may be less than the spacing between differential signal pairs.

Figure 4B:
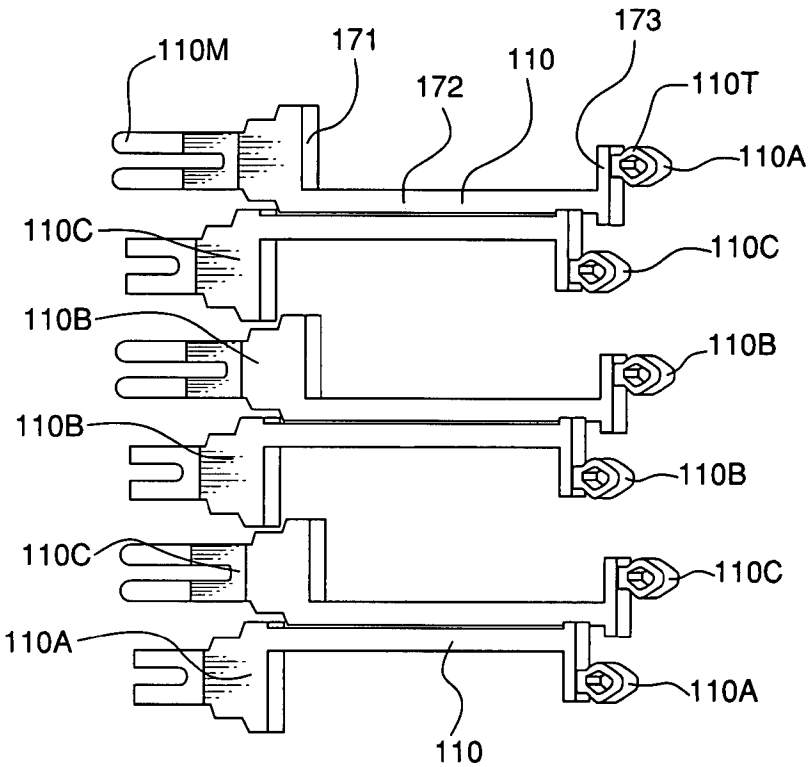
FIGS. 4B and 4C are, respectively, a perspective and a side view of contacts of the paired assemblies shown in FIG. 4A.
Figure 4A:
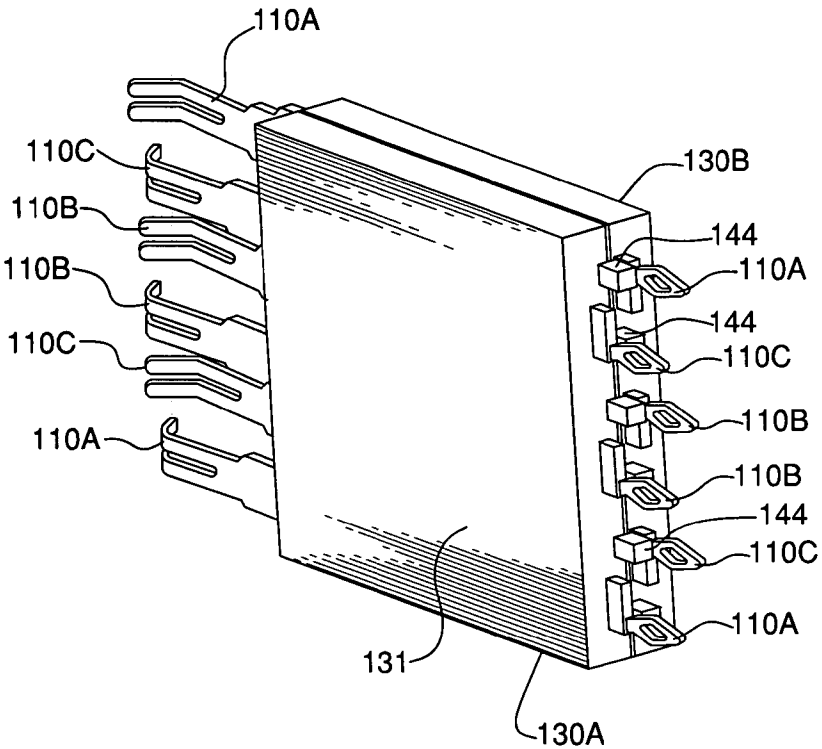
FIG. 4A is a perspective view of paired lead frame assemblies.

Referring to FIG. 4A, the contacts 110A, 110B, 110C may be insert molded within the lead frame bodies 131, and a shoulder 110TS where the contacts 110 protrude from the lead frame body 131 may be exposed. The shoulders 110TS may be electrically coupled in the absence of grounds or shields.

The lead frame assemblies 130 may include stand-offs 144 protruding from the lead frame body 131. The stand-offs 144 may protrude in a direction parallel to that in which the terminal ends 110T extend from the lead frame bodies 131. The stand-offs 144 may be located in any appropriate orientation and in the example embodiment of FIG. 2, the stand-offs 144 are adjacent to the terminal ends 110T of the contacts 110. The stand-offs 144 on each lead frame assembly 130 may be located in the same locations as the stand-offs 144 on the other lead frame assemblies 130. The stand-offs 144 may aid in uniformly connecting the electrical connector 100 to a substrate.

A space 160 may be created between the pairs of lead frame assemblies 130. Such a space may enable the connector 100 to be connected to a substrate while providing an area for trace routing.

Figure 3B:
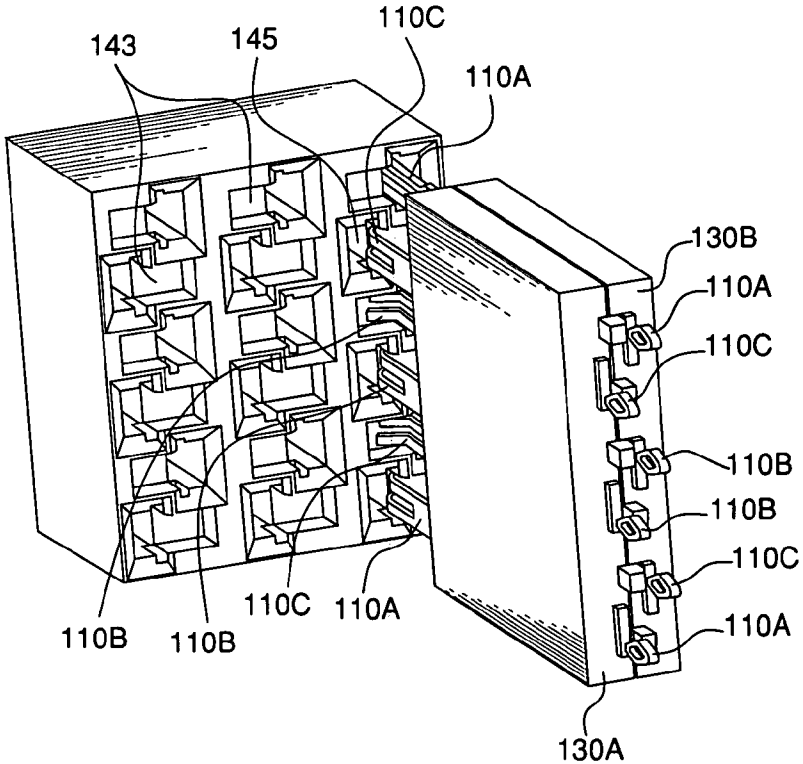
FIGS. 3A and 3B are, respectively, right and left perspective views of paired lead frame assemblies being inserted into a housing.
Figure 3A:
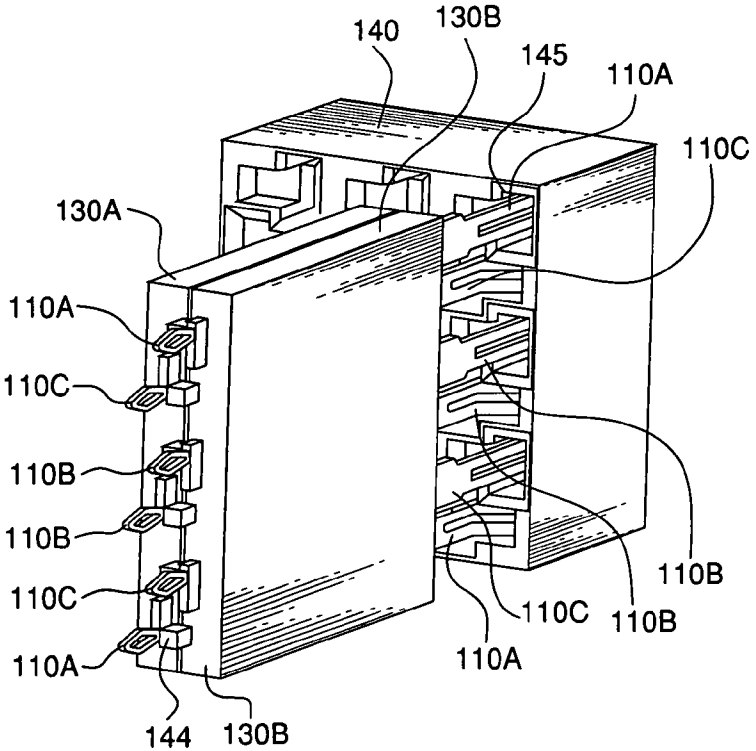
Figure 3C:
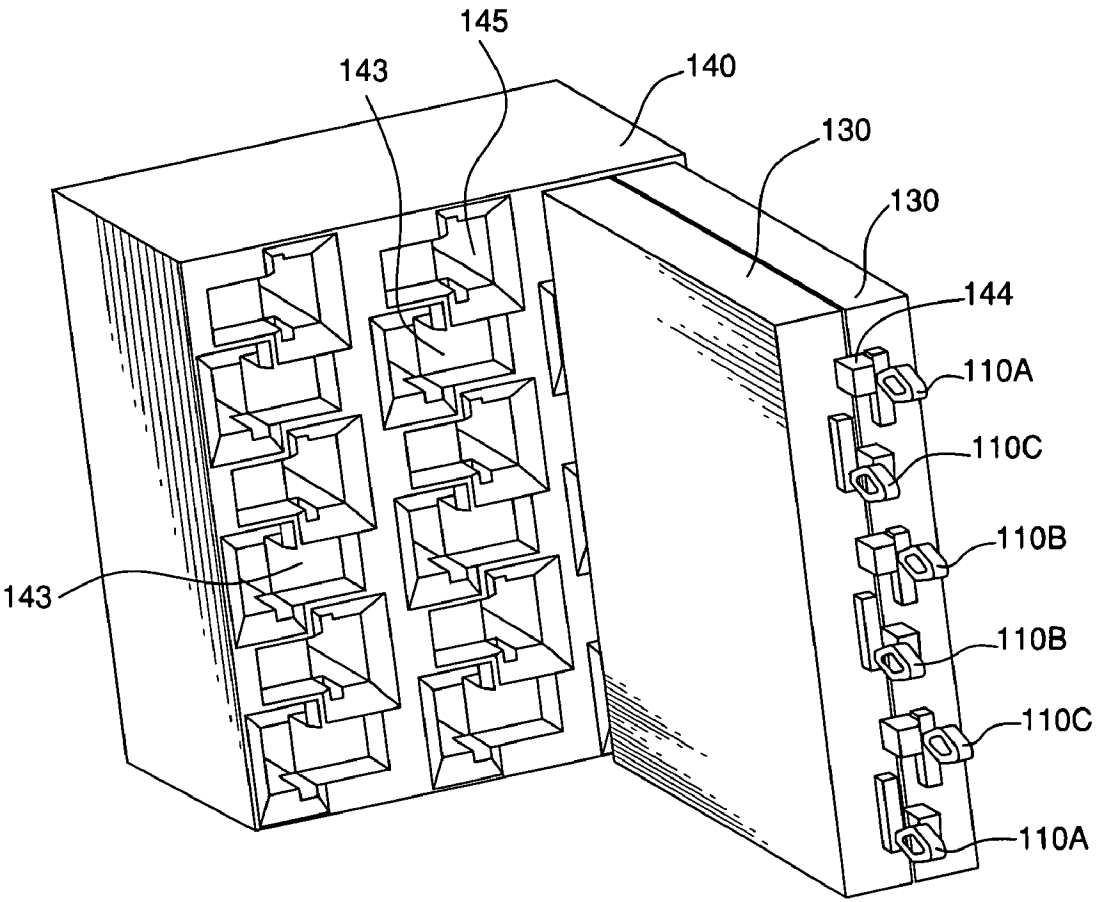
FIG. 3C is a perspective view of the paired assemblies inserted into a connector housing.

FIGS. 3A and 3B are, respectively, right and left perspective views of one set of paired lead frame assemblies 130A, 130B being inserted into the housing 140. FIG. 3C is a perspective view of the paired lead frame assemblies 130A, 130B inserted into the housing 140. The contacts 110 may be inserted into the apertures 145 of the housing 140, where a contact portion of the mating ends 110M of the contacts 110 may abut the block 143 as the contacts 110 are inserted into the housing 140 and as the lead frame assembly 130 is attached to the housing 140.

Figure 4C:
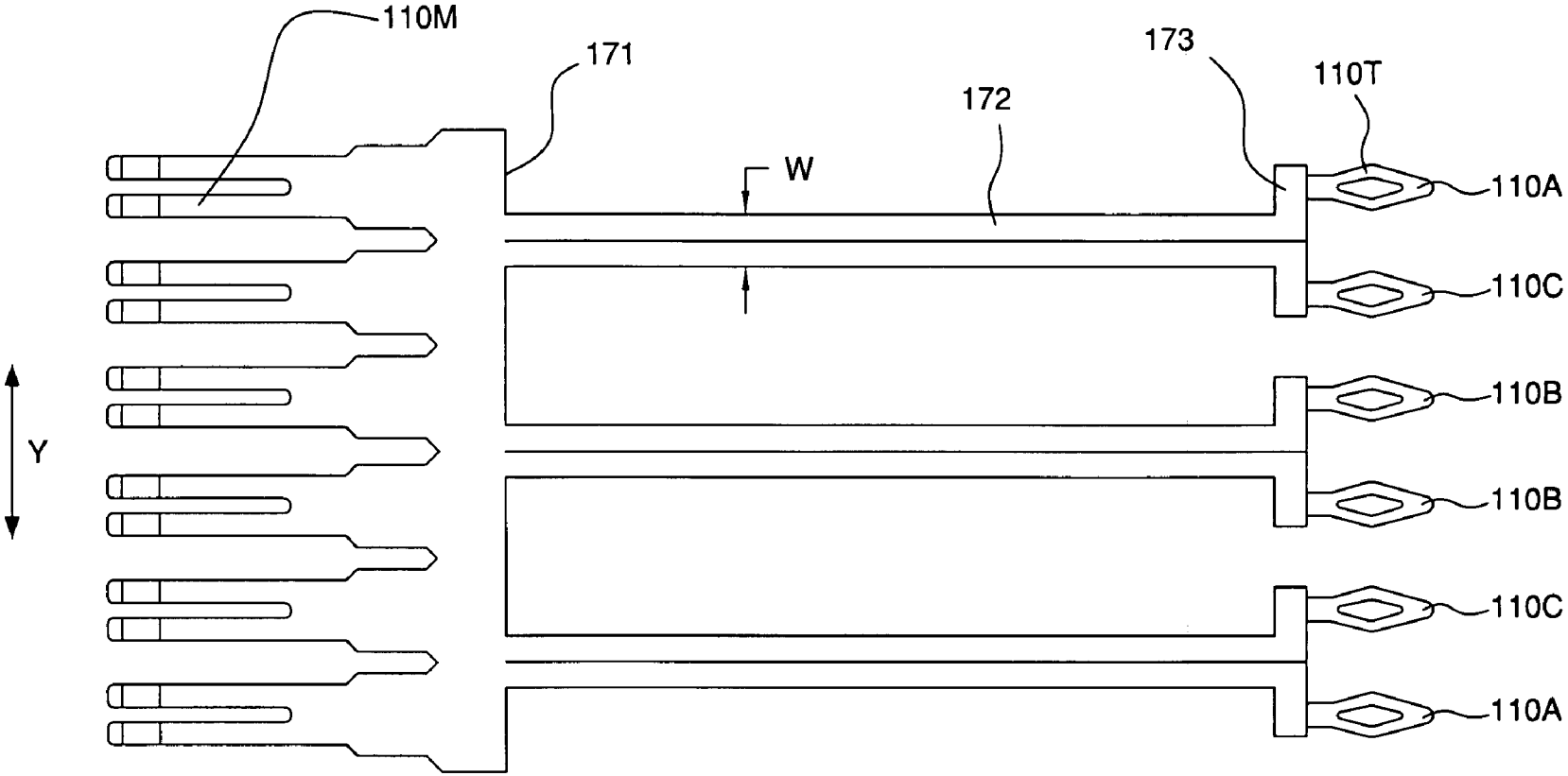

FIG. 4A is a perspective view of the paired lead frame assemblies 130A, 130B. FIG. 4B is a perspective view of the contacts 110 as shown in FIG. 4A but without the lead frame bodies 131 of the lead frame assemblies 130A, 130B. FIG. 4C is a side view of the contacts 110 of the paired lead frame assemblies 130A, 130B. The contacts 110A, 110B, 110C of the lead frame assembly 130A may be paired, respectively, with the contacts 110C, 110B, 110A of the lead frame assembly 130B.

The contacts may include a mating end 10M, a terminal end 110T and a body portion 110B between the mating end 110M and the terminal end 110T. The body portion 172 may extend from the mating end 110M to the terminal end 110T or, alternatively, may extend between a mating member 171 and a terminal member 173 that extend in a direction perpendicular to the direction in which the body portion 172 extends. The mating end 110M may extend from the mating member 171 in a direction parallel to the body portion 172. Likewise, the terminal end 110T may extend from the terminal member 173 in a direction parallel to the body portion 172.

The contacts 110 may be placed in or molded within the lead frame body 131 of the lead frame assembly 130 such that the body portions 172 of contacts 110 in a differential signal pair, such as the contacts 110A, 110C, are partially or fully coincident. That is, the body portions 172 of the contacts 110A, 110C that form a differential signal pair may overlap in a direction indicated by the arrow Y in FIG. 4C. In a preferred embodiment, the differential signal pair contacts 110 are not overlapped. However, the body portions 172 may overlap partially or completely such that, in the side view of FIG. 4C, the distance W is the width of one body portion 172. Alternatively, the distance W may be the width of the body portion 172 of the contact 110A plus the width of the body portion 172 of the contact 110C.

Figure 5B:
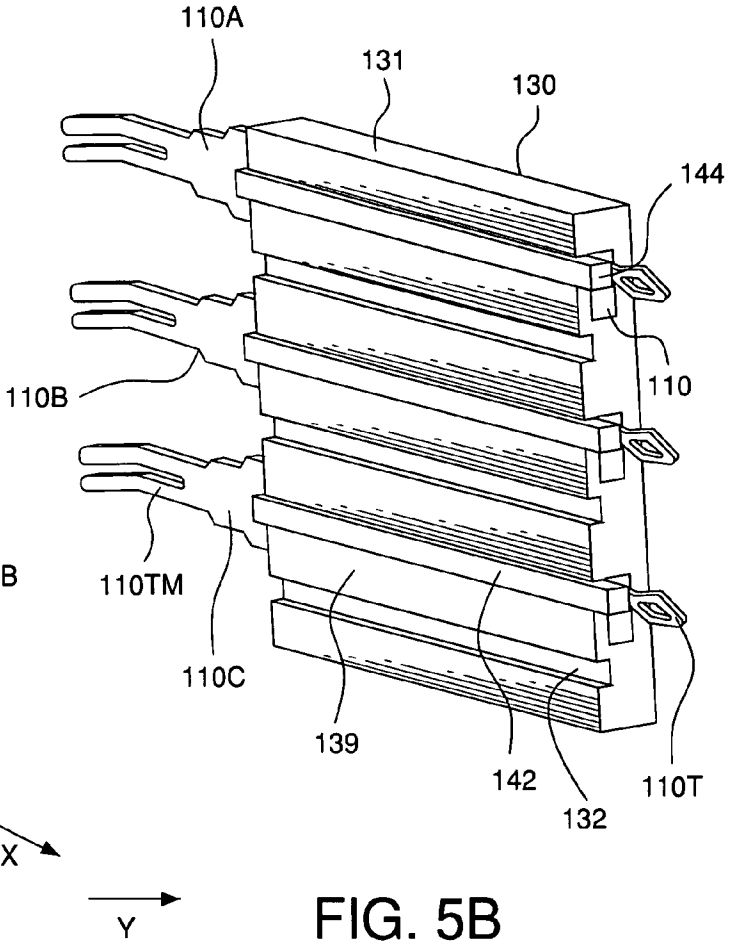
FIGS. 5A and 5B, respectively, are perspective outside and inside views of a lead frame assembly.
Figure 5A:
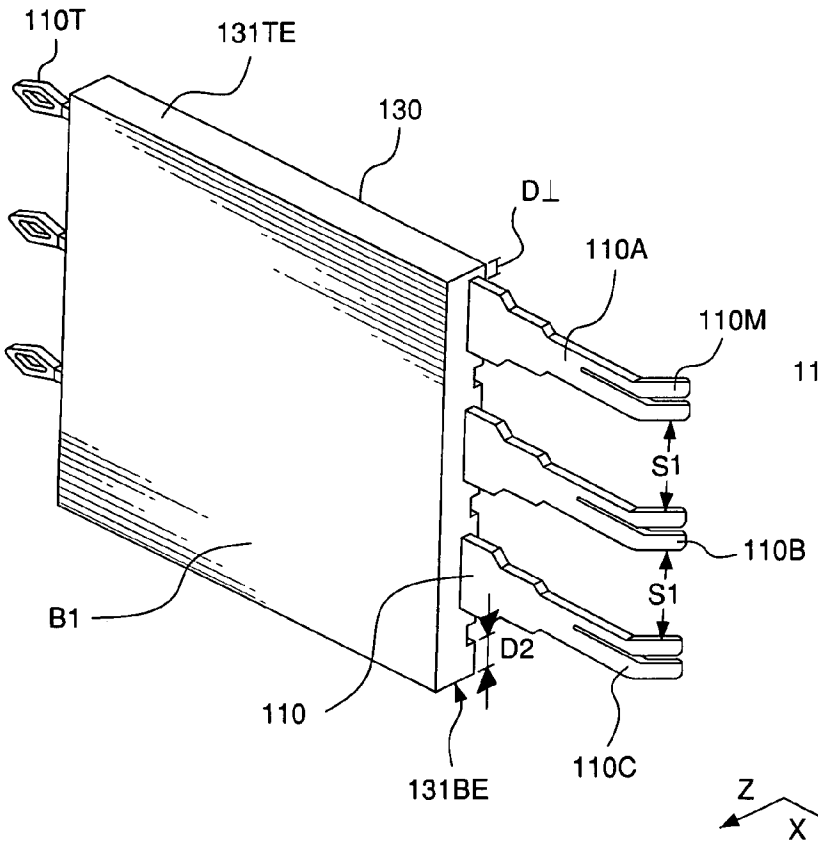
Figure 5C:
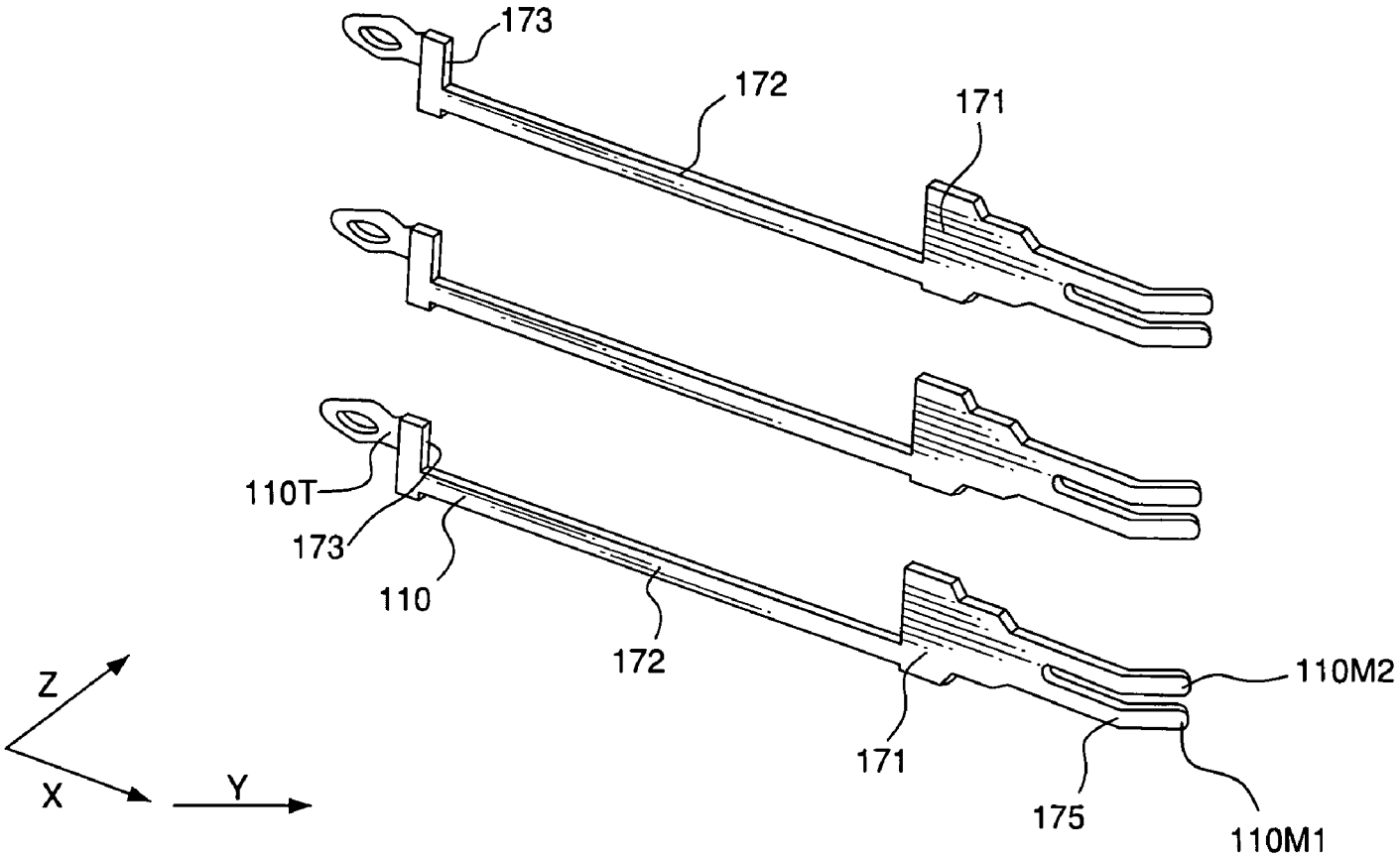
FIG. 5C is a perspective view of contacts 110 of the lead frame assembly shown in FIGS. 5A-5B without the lead frame body.

FIGS. 5A and 5B, respectively, are perspective outside and inside views of a lead frame assembly 130. FIG. 5C is a perspective view of contacts 110 of the lead frame assembly 130 shown in FIG. 5A without the lead frame body 131. The lead frame body 131 of the lead frame assembly 130 may include surface features such as protrusions 142 and indentations 132. The protrusions 142 may extend from a surface 139 of the lead frame body 131 and the indentations 132 may be molded into or otherwise formed into the surface 139 of the lead frame body 131. The protrusions 142 and indentations 132 may include complementary shapes and sizes such that each protrusion 142 may be received fully or partially in an indentation 132.

The protrusions 142 and indentations 132 for each lead frame body 131 or each lead frame assembly 130 may be in the same location as the protrusions 142 and indentations 132 of each of every other lead frame body 131 or lead frame assembly 130. The protrusions 142 and indentations 132 additionally may be located such that, when a first lead frame assembly 130A is paired with a second lead frame assembly 130B, the protrusions 142 of a first lead frame assembly 130A will be received in the indentations 132 of a second lead frame assembly 130B. Likewise, the indentations of the first lead frame assembly 130A will receive the protrusions 142 of the second lead frame assembly 130B. When a lead frame assembly 130 is mated with an identical lead frame assembly 130, the protrusions 142 and indentations 132 are located such that the pairs of lead frame assemblies 130 may be formed without requiring two types of lead frame assemblies 130.

As well as extending in a direction to be received in the indentations 132, the protrusions 142 may include respective stand-offs 144 that extend in a direction parallel to the terminal ends 110T of the contacts 110. As described herein, the stand-offs may protect the lead frame assembly 130, the connector 100, and the substrate to which the connector 100 is connected by ensuring that the terminal ends 110T extend a uniform distance for connecting to the substrate.

The contacts 110 may be arranged within the lead frame body 131 such that the contact 110A is spaced a distance D1 from a top edge 131TE shown in FIG. 5A. The contact 110C may be spaced a distance D2 from a bottom edge 131BE of the lead frame body 131. Additionally, the contact 110A may be spaced from the contact 110B by a spacing S1. Likewise, the contact 110B may be spaced from the contact 110C by the spacing S1. With this configuration, when the lead frame assembly 130 is rotated 180° and is mated with a second lead frame assembly 130 as shown in, for example, FIG. 4A, the contacts 110A may be offset from the contacts 110C and the contacts 110B of each lead frame assembly 130 may be offset from each other.

The contacts 110 may include a mating end 110M and a terminal end 110T. The mating end 110M may be forked. That is, the mating end 110T may include two separate mating portions 110M1, 110M2. The mating portions 110M1, 110M2 may extend in a direction parallel to the mating end 110M. Such a forked arrangement may aid in providing maximal electrical connectivity between the contact 110 and a respective mating contact of a second connector to which the connector 100 is connected. The mating portions 110M1, 110M2 each may abut a mating contact of a second connector, thus providing two surfaces that may conduct electricity. In this way, the mating portions 110M1, 110M2, may be bent or deflected independent of each other, which may help promote good connectivity. In alternative embodiments, the mating end 110T may be a single surface for connecting to a contact of a second connector.

The mating portions 110M1, 110M2 additionally may be bent in a direction to provide a lead in surface for mating with a contact of a second connector, thus promoting conductivity. As shown in FIGS. 5A-5C, the contact 110 may generally extend along a direction indicated by the arrow X, and the mating portions 110M1, 110M2 may generally be bent in a direction indicated by the arrow Y such that the mating portions 110M1, 110M2 are at an angle to the direction in which the contact 110 generally extends. The X direction may be the direction that the terminal end 110T and the mating end 110M may generally extend, except where the mating end 110M is bent to provide the lead-in surface. The mating end 110M of the contact 110 may be bent at approximately point 175 to increase connectivity. Such bending may help ensure connection with a contact of a second connector as this second bending may help extend conductive surfaces in a direction indicated by an arrow Z.

The contact 110, including the mating end 110M and the terminal end 110T may extend generally in the direction in which the contact 110 generally extends (e.g., the X direction). A body portion 172 may extend between the two ends 110M, 110T and may help define a length of the contact 110. The body portion 172 may terminate at one end at a mating member 171 and, at the opposite end, at a terminal member 173. The mating and terminal members 171, 173, may extend in a direction perpendicular to the direction in which the body portion 172 extends (that is, in a direction perpendicular to the X direction). From the mating member 171, the mating end 110M may extend. From the terminal member 173 the terminal end may extend. The mating end 110M and the terminal end 110T may extend in the X direction.

Figure 6A:
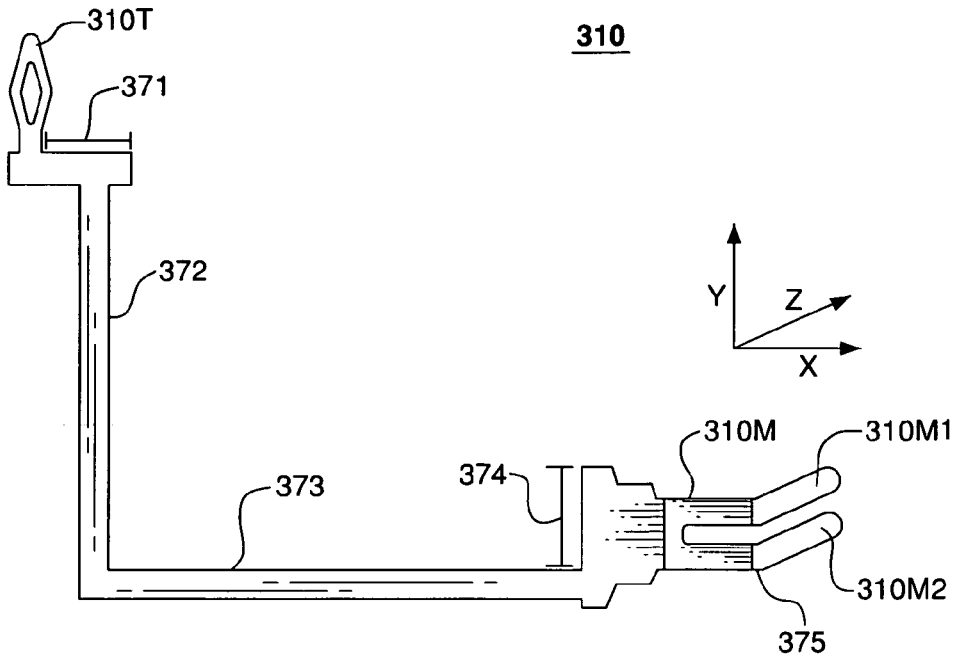
FIGS. 6A and 6B are side views of alternative contacts.
Figure 6B:
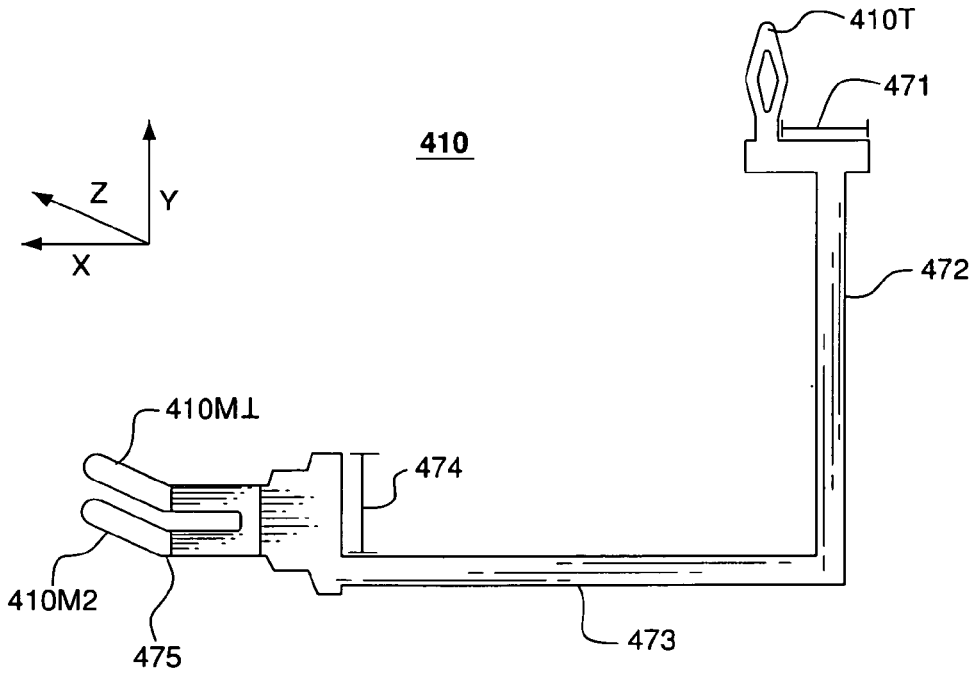

With the lead frame assemblies 130, the connector 100 may be used as a mezzanine connector and may be used to connect, for example, parallel substrates. In alternative embodiments, a connector may be used for back panel connections as well as coplanar connection of substrates. FIGS. 6A and 6B are side views of alternative contacts 310, 410 that may be used in right angle connectors. That is, the contacts 310, 410 may be molded as part of lead frame bodies to form lead frame assemblies in a right-angle configuration.

The contact 310, including the mating end 310M and the terminal end 310T may extend generally in orthogonal directions relative to one another, as indicated by the X and Y arrows, respectively, in FIG. 6A. A body portion 372 may extend in the Y direction between the terminal end 310T and a body portion 373. The body portion 372 may terminate at a terminal member 371. The terminal member 371 may extend in the X direction orthogonal to the direction that the body portion 372 extends, and the terminal end 310T may extend from the terminal member 371 in the direction in which the body portion 372 extends.

The body portion 373 may extend in the X direction between the body portion 372 and the mating end 310M. The body portion 373 may terminate at the mating member 374, which may extend in the Y direction perpendicular to the direction in which the body portion 373 extends. The mating end 310M may extend in the direction that the body portion 373 may extend and may be perpendicular to the direction that the mating member 374 extends. The contacts 310 may include a mating end 310M and a terminal end 310T. The mating end 310M may be forked. That is, the mating end 310T may include two separate mating portions 310M1, 310M2. The mating portions 310M1, 310M2 may extend in a direction parallel to the mating end 310M. Such a forked arrangement may help promote electrical connectivity between the contact 310 and a respective mating contact of a second connector. The mating portions 310M1, 310M2 each may abut a mating contact of a second connector, thus providing two surfaces that may conduct electricity. In alternative embodiments, the mating end 310M may be a single surface.

The mating portions 310M1, 310M2 additionally may be bent in a direction to provide a lead in surface for mating with a contact of a second connector, thus promoting conductivity. For example, the mating portions 310M1, 310M2 may generally be bent in a direction indicated by the arrow Z at a point 375.

The contact 410, including the mating end 410M and the terminal end 410T may extend generally in directions indicated by the arrows the X and Y in FIG. 6B. A body portion 472 may extend in the Y direction between the terminal end 410T and a body portion 473. The body portion 472 may terminate at a perpendicular extension 471. The perpendicular extension 471 may extend in a direction perpendicular to the body portion (e.g., in the X direction), and the terminal end 410T may extend from the perpendicular extension 471 in the direction in which the body portion 472 extends (e.g., the Y direction).

The body portion 473 may extend in a direction orthogonal to the body portion 472 (e.g., in the X direction) between the body portion 472 and the mating end 410M. The body portion 473 may terminate at the perpendicular extension 474, which may extend in the Y direction perpendicular to the body portion 473. The mating end 410M may extend in the direction that the body portion 473 extends (e.g., in the X direction) from the perpendicular extension 474. The contacts 410 may include a mating end 410M and a terminal end 410T. The mating end 410M may be forked. That is, the mating end 410T may include two separate mating portions 410M1, 410M2. The mating portions 410M1, 410M2 may extend in a direction parallel to the mating end 410M. In alternative embodiments, the mating end 410M may be a single surface.

The mating portions 410M1, 410M2 additionally may be bent in a direction indicated by the arrow Z. The mating end 410M of the contact 410 additionally may be bent such as at approximately point 475.

Figure 7:
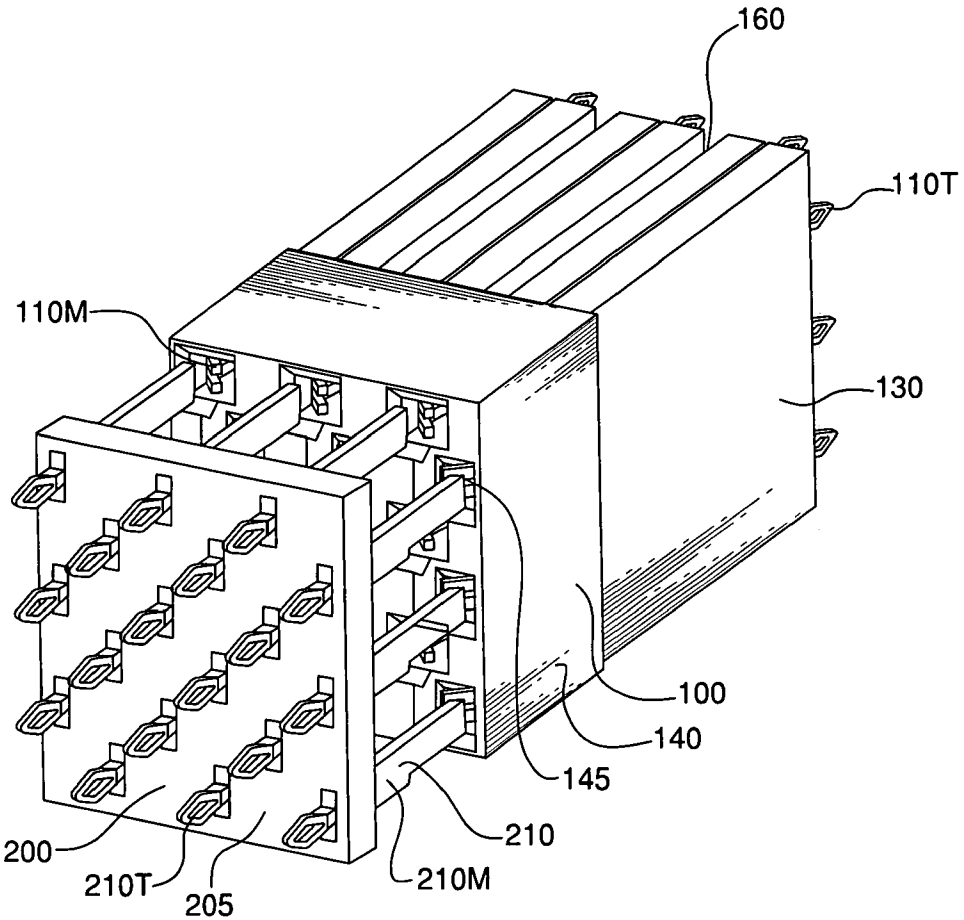
FIG. 7 is a perspective view of connectors being connected to each other.

FIG. 7 is a perspective view of the connector 100 and a connector 200 being connected to each other. The connector 100 may be the connector described in FIGS. 1-5C. The connector 200 may include contacts 210 extending through a connector body 205. Mating ends of the contacts 210 may be located within the connector body 205 to mate with contacts 110 of the connector 100 through apertures 145 of the housing 140. In this way, a substrate connected to the terminal ends 110T of the contacts 110 of the connector 100 may be connected to a substrate connected to terminal ends 210T of the contacts 210 of the connector 200.

Figure 8B:
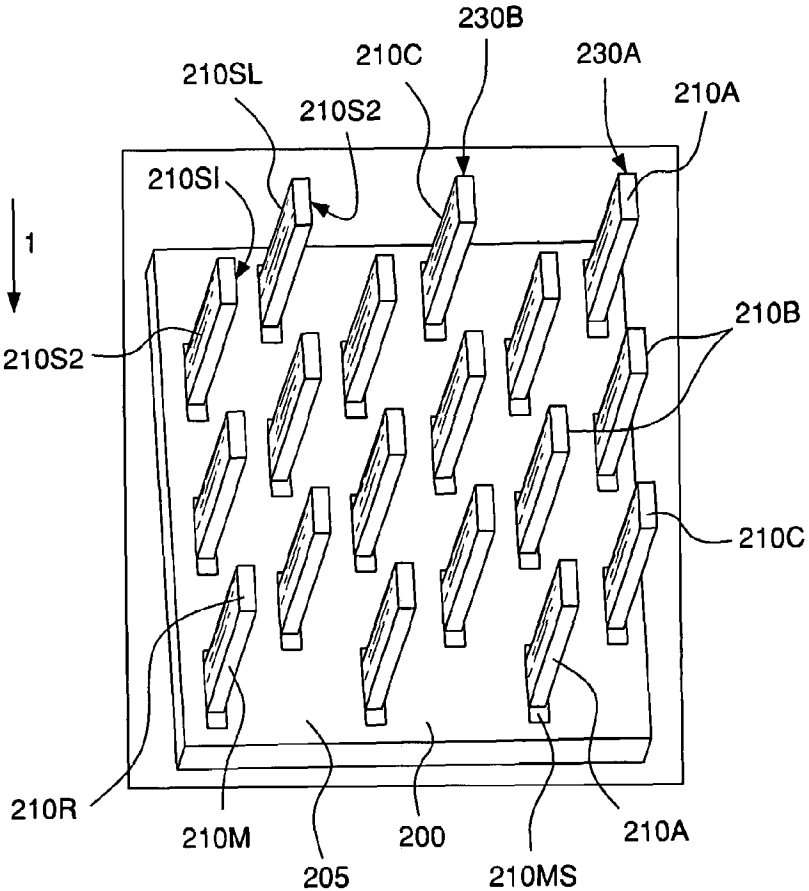
FIGS. 8A and 8B are perspective views of, respectively, front and back sides of a connector.
Figure 8A:
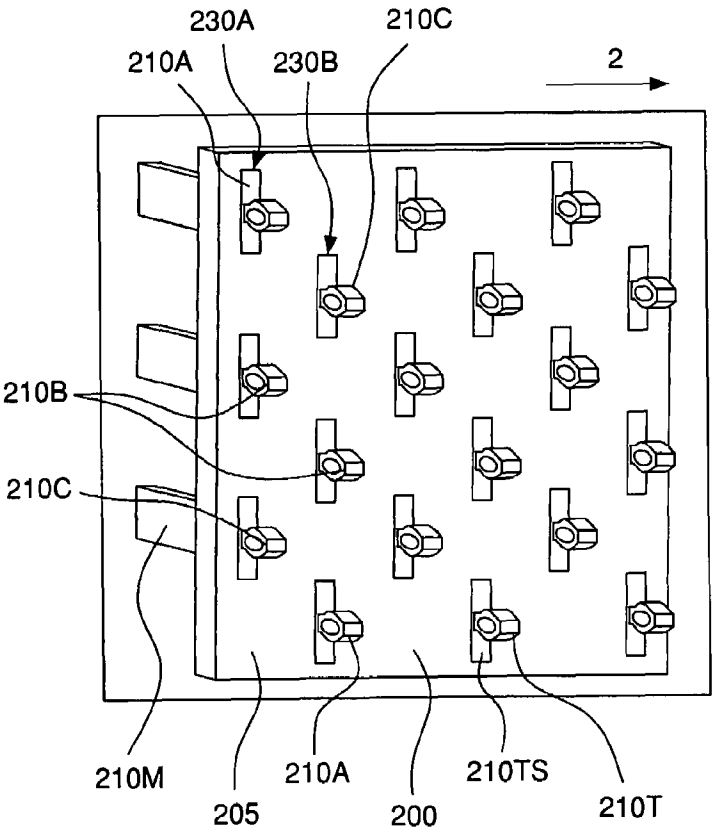

FIGS. 8A and 8B are perspective views of, respectively, front and back sides of the connector 200. The connector 200 may include contacts 210A, 210B, 210C extending through a connector body 205. The contacts 210 may form linear arrays or contact columns extending in a direction indicated by arrow 1. In the example connector 200, each linear array includes three contacts 210A, 210B, 210C. The contacts 210 may be used for single-ended signal transmission. In such a case, for example, the contacts 210A, 210C in a linear array 230A may be signal conductors and the contact 210B may be a ground contact. In a preferred embodiment, contacts 210A, 210C in respective arrays 230A, 230B may form differential signal pairs. Additionally, contacts 210B, 210B of respective arrays 230A, 230B may form differential signal pairs. Alternatively, contacts 210B, 210B of respective arrays 230A, 230B may be ground contacts. In another example, contacts 210A, 210B in a linear array 230A may form a differential signal pair, and the contact 210C in the array 230A may be a ground.

In the example connector 200, the contacts 210 may be paired with contacts 210 of an adjacent linear array rather than with contacts 210 within the same linear array. In such an embodiment, the connector 200 may be devoid of ground contacts. In a preferred embodiment, contacts forming differential signal pairs each may be the same distance in the direction indicated by the arrow 1 from a top edge of the connector body 205. That is, contacts forming a differential signal pair may be even with each other or not offset relative to one another in the direction indicated by arrow 1. Alternatively, as shown in FIGS. 8A and 8B, the contact 210A in the array 230A and the contact 210C in the array 230B may be spaced apart in the direction indicated by arrow 2 and offset in the direction indicated by the arrow 1. Such offsetting may enable a smaller "pitch"—or distance—between the contacts 210 within a differential signal pair in a direction indicated by the arrow 2, that is, in a direction perpendicular to the direction in which the arrays extend. In one embodiment of the invention, such a pitch may be about 1.3 to 2.6 mm in plastic, and smaller pitches in air.

In the connector 200, the contacts 210A of a linear array 230A extending in the direction indicated by the arrow 1 may be paired with the contact 210C of an adjacent linear array 230B. The contacts 210B of each of the adjacent linear arrays 230A, 230B may be paired together. Finally, the contact 210C of the linear array 230A may be paired with the contact 210A of the linear array 230A.

The mating ends 210M of the contacts 210 may be any appropriate shape to mate with contacts such as the mating ends 110M of the contacts 110 of the connector 100. The contacts may generally be rectangular, round, square or any other suitable shape. The mating ends 210M of the contacts 210 may include a ramped surface 210R that provides a complementary lead-in surface to the mating end 110M of respective contacts 110. To form the ramped surface, the mating end 210M of the contact 210 may be cut from a sheet of conductive material at an angle, resulting in a first side 210S1 being slightly shorter than an opposing side 210S2 of each contact. The first sides 210S1 within a pair of contacts 210 may be oriented towards each other as appropriate to provide a lead in surface that is appropriate for the configuration of respective contacts 110 of the connector 100.

The contacts may include shoulders 210MS, 210TS at each surface of the connector body 205. Thus, the contacts 210 may be wider where the contact 210 extends through the connector body 205 in comparison to the mating end 210M or terminal end 210T. The contacts 210 may be assembled as part of the connector body 205. Alternatively, the contacts 210 may be stitched or inserted into apertures formed in the connector body 205. The apertures and contacts 210 may be sized to provide an interference fit so that the contact 210 is appropriately secured within the connector body 205.

The contacts 210 additionally may be front loaded. In this way, the contacts 210 may be inserted with the mating end 210M being inserted into an aperture in the connector body 205 until a mid portion of the contact 210 between the shoulders 210MS, 210TS is held in the connector body 205. If, after the connector 210 is attached to a substrate, a contact 210 is damaged (e.g., bent or broken), the contact may be removed from the connector 200 by pulling on the mating end 210M, disengaging the contact 210 from the substrate, and withdrawing the contact 210 from the connector body 205. A new contact 210 may be inserted in its place. Each contact 210 may be removed without removing the connector 200 from the substrate. Thus the contacts 210 may be front loaded, providing for the connector 200 to be repaired after the connector is attached to a substrate and when it is in use.

Figure 9:
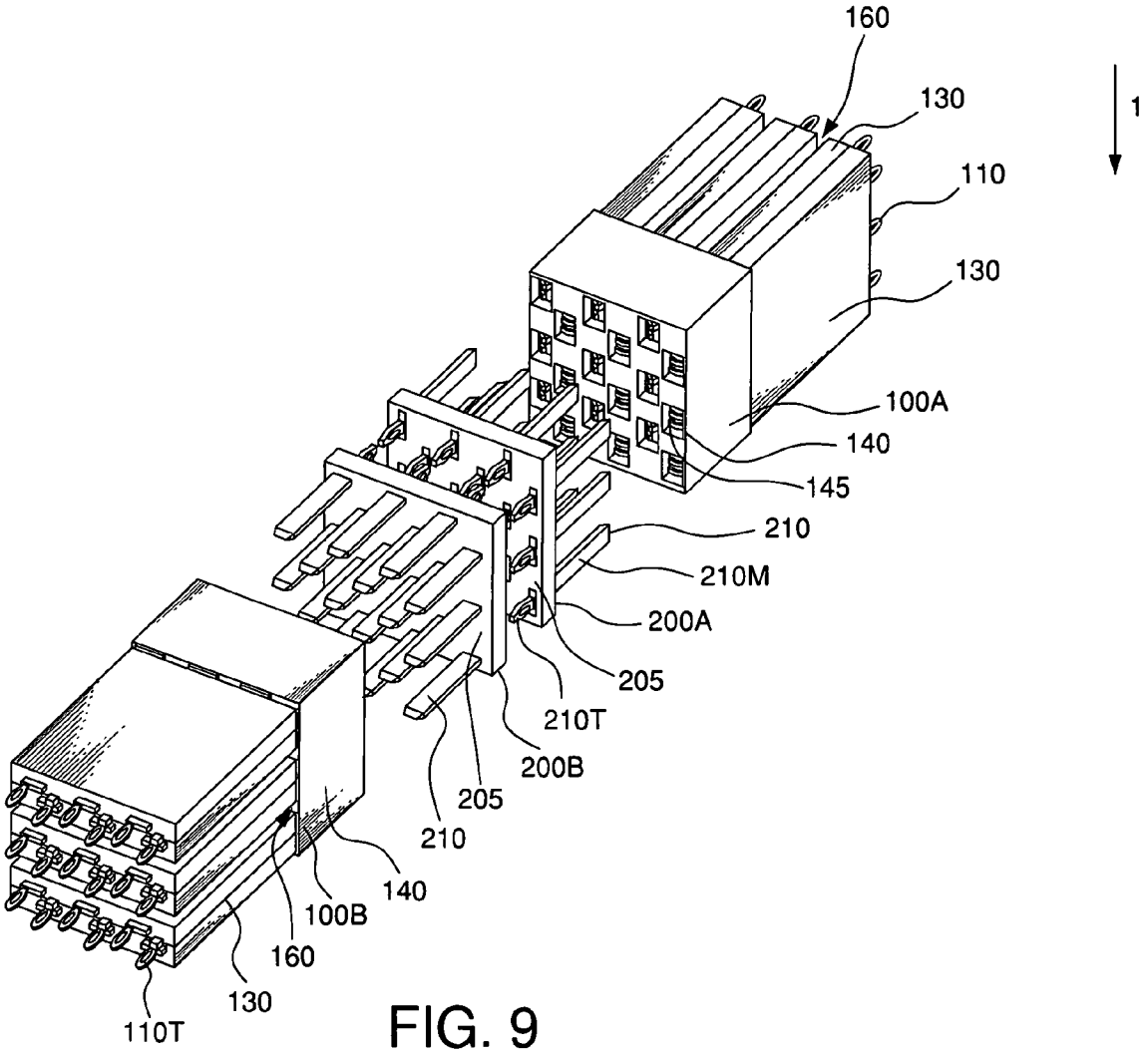
FIGS. 9 and 10 are, respectively, a perspective and a side view of connectors connected orthogonally to a substrate.
Figure 10:
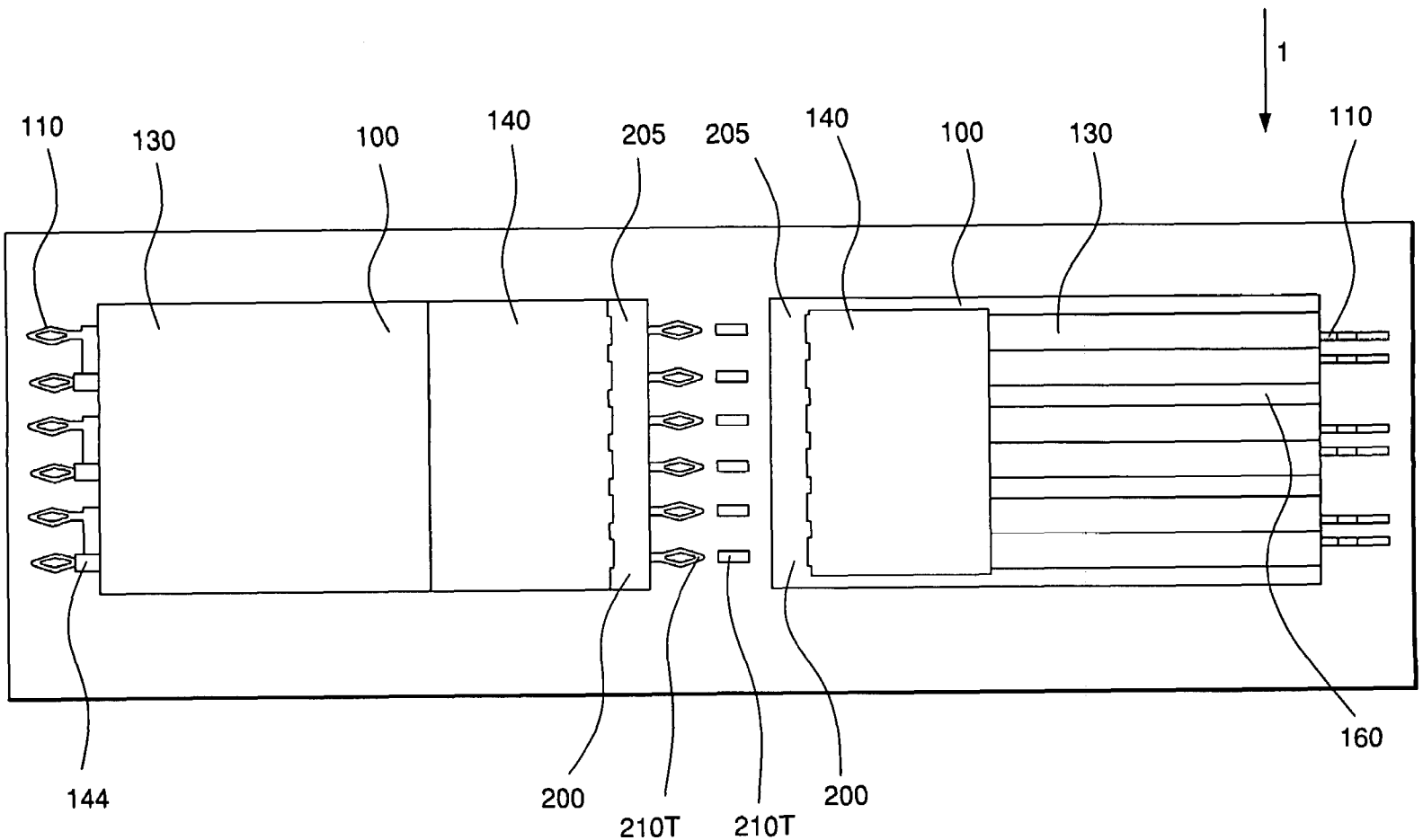

FIGS. 9 and 10 are, respectively, a perspective and a side view of connectors 100, 200 connected orthogonally. The connectors 100, 200 may be shown as they would appear connected to a midplane located between connector 200A and connector 200B. Such a midplane, however, is not shown for purposes of clarity. Connectors 100A, 100B are each disposed to connect to a substrate such as a printed circuit board. Thus the arrangement shown in FIG. 9 may be used to connect parallel printed circuit boards. As used in the art, orthogonal generally refers to the orientation of the daughtercard boards with respect to the midplane and with respect to one another. As used herein, orthogonal can mean any transverse intersection of a contact tail and a board, the orientation of a housing with respect to a board, or the orientation of two mating boards. FIG. 9 is an exploded view, depicting the connectors 100, 200 being connected orthogonally through a midplane printed circuit board. Again, the midplane is not shown for purposes of clarity.

Vertical connectors are shown, and therefore daughtercard boards connected to respective connectors 110A, 100B may not be orthogonal to one another or to the midplane. However, if a right angle connector is substituted for the connector 100A, for example, the daughtercard boards may be orthogonal with respect to the midplane. If one daughtercard board is rotated 90 degrees, then the daughtercard boards may be orthogonal, i.e, the daughtercard boards may be generally orthogonal to the midplane and to each other.

FIG. 10 shows the connectors 100, 200 connected orthogonally as they would appear connected to a midplane located between the connector 200A and the connector 200B. The midplane is not shown for purposes of clarity. That is, the terminal ends 210T of the connectors 200 would be connected to a midplane substrate in the embodiments shown in FIGS. 9 and 10 but a midplane is not shown for purposes of clarity.

A connector 100A may be connected to a connector 200A. The connector 100A may be the connector 100 as described with regard to FIGS. 1-5C. The connector 200A may be the connector 200 as described with regard to FIGS. 7-8B. The connector 100A may be oriented such that the contacts 110 within the lead frame assemblies 130 form linear arrays in a direction indicated by the arrow 1. Likewise, the linear arrays of contacts 210 of the connector 200A may be oriented in the direction indicated by the arrow 1.

The connector 200 may be connected to one side of a midplane (not shown). On an opposing side of the midplane, the connector 200B may be attached. The connector 200B may be the connector 200 described with regard to FIGS. 1-8B. The connector 200B may be connected to the connector 100B, which may be the connector 100 described with regard to FIGS. 1-5C. The lead frame assemblies 130 of the connector 100B may extend in a direction perpendicular to the direction indicated by the arrow 1. Likewise, the linear arrays of contacts 210 of the connector 200B may extend in a direction perpendicular to the direction indicated by the arrow 1. The connector 100B may be identical to the connector 100A and may be rotated 90° relative to the connector 100A. Likewise, the connector 200B may be identical to the connector 200A but may be rotated 90° relative to the connector 200A. In this way, a substrate connected to the mating ends 110M of respective connectors 100A, 100B may be electrically connected to one another.

As shown in FIGS. 9 and 10, the connectors 100, 200 may be connected through a midplane (not shown). The connectors 100, 200 may be devoid of any ground connection through ground contacts, shields, planes, or otherwise. The contact arrangement as described herein may provide for appropriate cross-talk, skew, and impedance matching. Various other contact configurations consistent with alternative embodiments of the invention are envisioned to likewise provide for appropriate cross-talk, skew, and impedance matching.

What is claimed:

1. An electrical connector comprising:

a first contact comprising a first distal end;

a second contact comprising a first distal end, wherein the first and second contacts define a first linear array extending along a first direction; and a third contact in a second linear array that is adjacent to the first linear array, the second linear array extending along the first direction, the third contact comprising a first distal end that is offset along the first direction relative to the first distal end of the first contact, wherein the first and third contacts form a differential signal pair, and wherein the third contact is structurally identical to the first contact and is oriented 180° about an imaginary axis that extends in a direction perpendicular to the first direction.

2. The electrical connector of claim 1, wherein each of the first and second contacts are at least partially received in a first lead frame assembly, and wherein the third contact is at least partially received in a second lead frame assembly.

3. The electrical connector of claim 2, wherein the second lead frame assembly is structurally identical to the first lead frame assembly and is oriented 180° about the imaginary axis that extends in the direction perpendicular to the first direction.

4. The electrical connector of claim 2, wherein the second lead frame assembly abuts the first lead frame assembly.

5. The electrical connector of claim 4, wherein the first lead frame assembly comprises an indentation and the second lead frame assembly comprises a protrusion, and wherein the protrusion is received in the indentation.

6. The electrical connector of claim 5, wherein the protrusion extends from the first lead frame assembly and abuts a substrate when the electrical connector is electrically connected to the substrate.

7. The electrical connector of claim 4, further comprising a third lead frame assembly adjacent to and spaced apart from the second lead frame assembly.

8. The electrical connector of claim 1, wherein the connector is devoid of a grounding plane.

9. The electrical connector of claim 1, wherein the connector is devoid of ground contacts.

10. The electrical connector of claim 1, wherein the first contact comprises a first body extending between a first mating end and a first terminal end, wherein the second contact comprises a second body extending between a second mating end and a second terminal end, wherein the third contact comprises a third body extending between a third mating end and a third terminal end, wherein the first and second bodies define a first plane, and wherein the first and third bodies define a second plane that is perpendicular to the first plane.

11. The electrical connector of claim 1, further comprising:

a housing, wherein the first, second, and third contacts are received in the housing, and wherein the housing is disposed for flat rock tooling to connect the electric connector to a substrate.

12. A system, comprising:

a first electrical connector comprising, a first contact comprising a first distal end;

a second contact comprising a first distal end, wherein the first and second contacts define a first linear array extending along a first direction;

a third contact in a second linear array that is adjacent to the first linear array, the second linear array extending along the first direction, the third contact comprising a first distal end that is offset along the first direction relative to the first distal end of the first contact, wherein the first and third contacts form a differential signal pair, wherein the third contact is structurally identical to the first contact and is oriented 180° about an imaginary axis that extends in a direction perpendicular to the first direction; and a second electrical connector comprising, a fourth contact electrically connected to the first contact; and a fifth contact electrically connected to the third contact.

13. The system of claim 12, wherein the second connector further comprises a connector body, wherein the fourth and fifth contacts are at least partially received in the connector body and the fourth contact is adapted to be removed from the connector body while the fifth contact remains connected to a substrate.

14. The system of claim 12, further comprising:

a substrate comprising a first side and a second side opposite the first side, wherein the second connector is electrically connected to the first side of the substrate; and a third connector electrically connected to the second side of the substrate, the third connector comprising a structure that is the same as the first connector, wherein the third connector is in a position that is oriented 90° relative to the first connector.

15. An electrical connector comprising:

a first contact comprising a first distal end;

a second contact comprising a first distal end, wherein the first and second contacts define a first linear array extending along a first direction; and a third contact in a second linear array that is adjacent to the first linear array, the second linear array extending along the first direction, the third contact comprising a first distal end that is offset along the first direction relative to the first distal end of the first contact, wherein the first and third contacts form a differential signal pair, wherein each of the first and second contacts are at least partially received in a first lead frame assembly, wherein the third contact is at least partially received in a second lead frame assembly, and wherein the second lead frame assembly is structurally identical to the first lead frame assembly and is oriented 180° about an imaginary axis that extends in a direction perpendicular to the first direction.

16. The electrical connector of claim 15, wherein the second lead frame assembly abuts the first lead frame assembly.

17. The electrical connector of claim 15, wherein the first lead frame assembly comprises an indentation and the second lead frame assembly comprises a protrusion, and wherein the protrusion is received in the indentation.

18. The electrical connector of claim 17, wherein the protrusion extends from the first lead frame assembly and abuts a substrate when the electrical connector is electrically connected to the substrate.

19. The electrical connector of claim 15, further comprising a third lead frame assembly adjacent to and spaced apart from the second lead frame assembly.

20. The electrical connector of claim 15, wherein the connector is devoid of a grounding plane.

21. The electrical connector of claim 15, wherein the connector is devoid of ground contacts.

22. The electrical connector of claim 15, wherein the first contact comprises a first body extending between a first mating end and a first terminal end, wherein the second contact comprises a second body extending between a second mating end and a second terminal end, wherein the third contact comprises a third body extending between a third mating end and a third terminal end, wherein the first and second bodies define a first plane, and wherein the first and third bodies define a second plane that is perpendicular to the first plane.

23. The electrical connector of claim 15, further comprising a housing, wherein the first, second, and third contacts are received in the housing, and wherein the housing is disposed for flat rock tooling to connect the electric connector to a substrate.

* * * * *